US010668725B2

(12) United States Patent
Nishimura

(10) Patent No.: US 10,668,725 B2
(45) Date of Patent: Jun. 2, 2020

(54) SUPPLY MANIFOLD IN A PRINTHEAD

(71) Applicant: Hiroshi Nishimura, West Hills, CA (US)

(72) Inventor: Hiroshi Nishimura, West Hills, CA (US)

(73) Assignee: Ricoh Company, Ltd., Tokyo (JP)

( * ) Notice: Subject to any disclaimer, the term of this patent is extended or adjusted under 35 U.S.C. 154(b) by 132 days.

(21) Appl. No.: 15/913,778

(22) Filed: Mar. 6, 2018

(65) Prior Publication Data

US 2019/0275794 A1 Sep. 12, 2019

(51) Int. Cl.

| | |
|---|---|
| ***B41J 2/14*** | (2006.01) |
| ***B41J 2/175*** | (2006.01) |
| ***B41J 2/17*** | (2006.01) |

(52) U.S. Cl.

CPC ..... *B41J 2/1433* (2013.01); *B41J 2/14274* (2013.01); *B41J 2/175* (2013.01); *B41J 2/1707* (2013.01); *B41J 2002/14403* (2013.01); *B41J 2002/14419* (2013.01); *B41J 2202/08* (2013.01)

(58) Field of Classification Search

CPC ..... B41J 2/1433; B41J 2/175; B41J 2/1707; B41J 2002/14419; B41J 2002/14467; B41J 2/17513

See application file for complete search history.

(56) References Cited

U.S. PATENT DOCUMENTS

| | | | | |
|---|---|---|---|---|
| 5,682,190 | A * | 10/1997 | Hirosawa | B41J 2/14145 347/42 |
| 6,007,193 | A * | 12/1999 | Kashimura | B41J 2/1707 347/18 |
| 6,457,820 | B1 | 10/2002 | Cai et al. | |
| 2006/0103699 | A1 | 5/2006 | Hoisington et al. | |
| 2007/0070106 | A1* | 3/2007 | Yasuda | B41J 2/155 347/13 |
| 2008/0252707 | A1 | 10/2008 | Kusunoki | |
| 2010/0073433 | A1 | 3/2010 | Shimizu et al. | |

(Continued)

FOREIGN PATENT DOCUMENTS

| | | |
|---|---|---|
| EP | 0594110 B1 | 4/1994 |
| EP | 3121011 A1 | 1/2017 |
| WO | 9512109 A1 | 5/1995 |

OTHER PUBLICATIONS

European Search Report; Application EP19159451; dated Aug. 13, 2019.

*Primary Examiner* — Henok D Legesse
(74) *Attorney, Agent, or Firm* — Duft & Bornsen, PC

(57) ABSTRACT

Printheads for jetting a print fluid. In one embodiment, a printhead includes a main body configured to attach to a stack of plates, where the stack of plates forms a row of jetting channels configured to jet droplets of a print fluid. The main body includes a supply manifold configured to provide a fluid path for the print fluid to the row of jetting channels. The supply manifold comprises a primary manifold duct and a secondary manifold duct that extend in parallel in alignment with the row of jetting channels. The primary manifold duct is fluidly isolated from the secondary manifold duct at end sections of the primary manifold duct, and is fluidly coupled to the secondary manifold duct toward a midsection of a length of the primary manifold duct. The secondary manifold duct is fluidly coupled to the row of jetting channels.

20 Claims, 5 Drawing Sheets

(56) References Cited

U.S. PATENT DOCUMENTS

| | | | |
|---|---|---|---|
| 2011/0205306 | A1 | 8/2011 | Vaeth et al. |
| 2013/0233418 | A1 | 9/2013 | Aldrich et al. |
| 2014/0300666 | A1 | 10/2014 | Johnson et al. |
| 2017/0368835 | A1 | 12/2017 | Otis et al. |

* cited by examiner

SUPPLY MANIFOLD IN A PRINTHEAD

FIELD OF THE INVENTION

The following disclosure relates to the field of image formation, and in particular, to printheads and the use of printheads.

BACKGROUND

Image formation is a procedure whereby a digital image is recreated on a medium by propelling droplets of ink or another type of print fluid onto a medium, such as paper, plastic, a substrate for 3D printing, etc. Image formation is commonly employed in apparatuses, such as printers (e.g., inkjet printer), facsimile machines, copying machines, plotting machines, multifunction peripherals, etc. The core of a typical jetting apparatus or image forming apparatus is one or more liquid-droplet ejection heads (referred to generally herein as "printheads") having nozzles that discharge liquid droplets, a mechanism for moving the printhead and/or the medium in relation to one another, and a controller that controls how liquid is discharged from the individual nozzles of the printhead onto the medium in the form of pixels.

A typical printhead includes a plurality of nozzles aligned in one or more rows along a discharge surface of the printhead. Each nozzle is part of a "jetting channel", which includes the nozzle, a pressure chamber, and an actuator, such as a piezoelectric actuator. A printhead also includes a drive circuit that controls when each individual jetting channel fires based on image data. To jet from a jetting channel, the drive circuit provides a jetting pulse to the actuator, which causes the actuator to deform a wall of the pressure chamber. The deformation of the pressure chamber creates pressure waves within the pressure chamber that eject a droplet of print fluid (e.g., ink) out of the nozzle.

Drop on Demand (DoD) printing is moving towards higher productivity and quality, which requires small droplet sizes ejected at high jetting frequencies. The print quality delivered by a printhead depends on ejection or jetting characteristics, such as droplet velocity, droplet mass (or volume/diameter), jetting direction, etc. Temperature of the print fluid in the printhead may affect the jetting characteristics, so it is therefore desirable to control the temperature of the print fluid within a printhead.

SUMMARY

Embodiments described herein provide an enhanced supply manifold in a printhead. A supply manifold in a printhead provides a fluid path for a print fluid between a fluid source and a row of jetting channels. For example, a supply manifold in a conventional printhead may comprise a groove in the main body of the printhead that is aligned with the row of jetting channels (i.e., aligned with restrictors of the jetting channels). The print fluid flows through the groove to each of the jetting channels. One limitation with this conventional design is that the print fluid may be at different temperatures along the length of the supply manifold, which can affect jetting characteristics along a row of jetting channels. For instance, the temperature of the print fluid may be lower towards the ends of the supply manifold as compared to the center of the supply manifold.

The enhanced supply manifold as described herein has a primary manifold duct and a secondary manifold duct that are fluidly connected via holes toward the center of the supply manifold. The structure of the supply manifold forces the print fluid to flow from the ends of the primary manifold duct toward the center of the primary manifold duct for at least a threshold distance before the print fluid is allowed to flow through to the second manifold duct. The print fluid may be heated while flowing through the primary manifold duct so that the print fluid reaches a threshold temperature before flowing into the second manifold duct. Thus, the print fluid that flows into the second manifold duct will be at a desired temperature for jetting, which allows for consistent droplet formation along a row of jetting channels and higher print quality.

One embodiment comprises a printhead that includes a main body configured to attach to a stack of plates, where the stack of plates forms a row of jetting channels configured to jet droplets of a print fluid. The main body includes a supply manifold configured to provide a fluid path for the print fluid to the row of jetting channels. The supply manifold comprises a primary manifold duct and a secondary manifold duct that extend in parallel in alignment with the row of jetting channels. The primary manifold duct is fluidly isolated from the secondary manifold duct at end sections of the primary manifold duct, and is fluidly coupled to the secondary manifold duct toward a midsection of a length of the primary manifold duct. The secondary manifold duct is fluidly coupled to the row of jetting channels.

Another embodiment comprises a printhead that includes a main body, and a stack of plates attached to the main body, and that forms a row of jetting channels configured to jet droplets of a print fluid. The main body includes a rigid body member, a manifold plate, and a flow diversion plate sandwiched between an interface surface of the rigid body member and the manifold plate. The rigid body member includes a primary manifold duct formed into the interface surface. The flow diversion plate includes a row of orifices in alignment with the primary manifold duct. The manifold plate includes a manifold opening that forms a secondary manifold duct in alignment with the primary manifold duct. The secondary manifold duct is fluidly coupled to the row of jetting channels.

Another embodiment comprises a printhead that includes a main body having supply ports configured to receive a print fluid, and a stack of plates attached to the main body, and that forms a row of jetting channels configured to jet droplets of the print fluid. The main body includes a supply manifold configured to provide a fluid path for the print fluid from the supply ports to the row of jetting channels. The supply manifold comprises a first fluid passage that fluidly couples to a first one of the supply ports, a second fluid passage that fluidly couples to a second one of the supply ports, a primary manifold duct extending between the first fluid passage and the second fluid passage, and a secondary manifold duct that extends in alignment with the primary manifold duct and fluidly couples with the row of jetting channels. The supply manifold further comprises a fluid diversion plate disposed between the primary manifold duct and the secondary manifold, and that fluidly isolates the primary manifold duct from the secondary manifold duct at end sections of the primary manifold duct. The fluid diversion plate includes one or more orifices, positioned toward a midsection of a length of the primary manifold duct, that fluidly couple the primary manifold duct to the secondary manifold duct.

The above summary provides a basic understanding of some aspects of the specification. This summary is not an extensive overview of the specification. It is intended to neither identify key or critical elements of the specification nor delineate any scope particular embodiments of the specification, or any scope of the claims. Its sole purpose is to present some concepts of the specification in a simplified form as a prelude to the more detailed description that is presented later.

DESCRIPTION OF THE DRAWINGS

Some embodiments of the present disclosure are now described, by way of example only, and with reference to the accompanying drawings. The same reference number represents the same element or the same type of element on all drawings.

DETAILED DESCRIPTION

The figures and the following description illustrate specific exemplary embodiments. It will thus be appreciated that those skilled in the art will be able to devise various arrangements that, although not explicitly described or shown herein, embody the principles of the embodiments and are included within the scope of the embodiments. Furthermore, any examples described herein are intended to aid in understanding the principles of the embodiments, and are to be construed as being without limitation to such specifically recited examples and conditions. As a result, the inventive concept(s) is not limited to the specific embodiments or examples described below, but by the claims and their equivalents.

Figure 1:
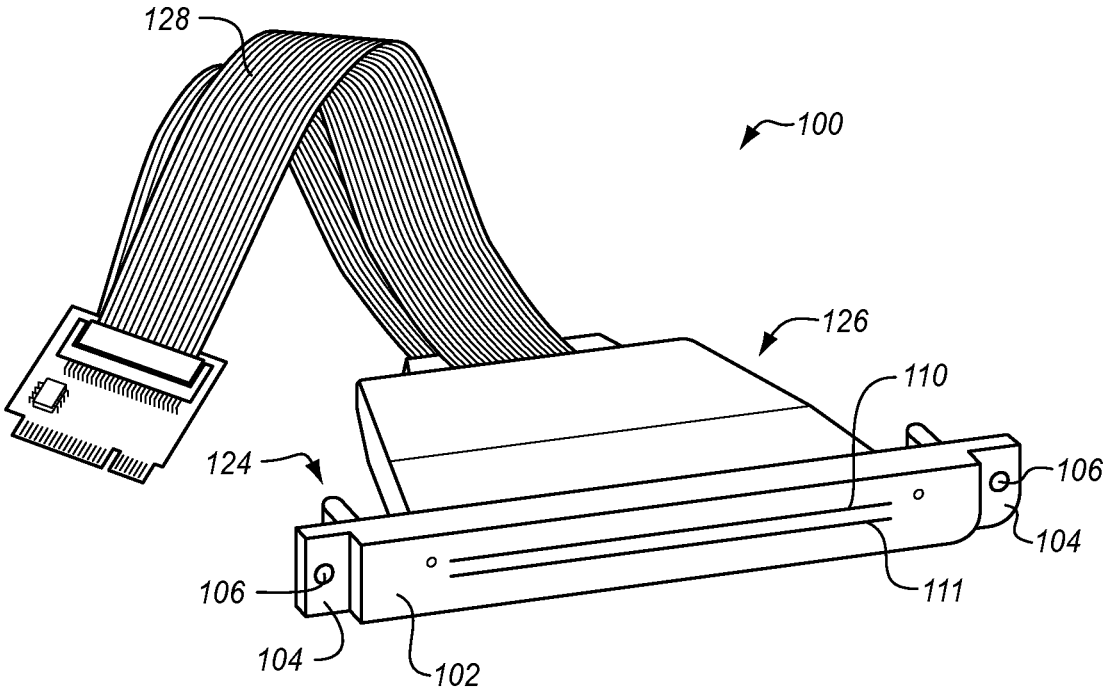
FIG. 1 is a perspective view of a printhead in an illustrative embodiment.

FIG. 1 is a perspective view of printhead 100 in an illustrative embodiment. Printhead 100 includes a nozzle plate 102, which represents the discharge surface of printhead 100. Nozzle plate 102 includes a plurality of nozzles that jet or eject droplets of print fluid onto a medium, such as paper, plastic, card stock, transparent sheets, a substrate for 3D printing, cloth, and the like. Nozzles of printheads 100 are arranged in one or more rows 110-111 so that ejection of print fluid from the nozzles causes formation of characters, symbols, images, layers of an object, etc., on the medium as printhead 100 and/or the medium are moved relative to one another. Although two rows 110-111 of nozzles are illustrated in FIG. 1, printhead 100 may include a single row of nozzles, three rows of nozzles, four rows of nozzles, etc. Printhead 100 also includes attachment members 104. Attachment members 104 are configured to secure printhead 100 to a jetting apparatus. Attachment members 104 may include one or more holes 106 so that printhead 100 may be mounted within a jetting apparatus by screws, bolts, pins, etc. Opposite nozzle plate 102 is the side of printhead 100 used for input/output (I/O) of print fluid, electronic signals, etc. This side of printhead 100 is referred to as the I/O side 124. I/O side 124 includes electronics 126 that connect to a controller board through cabling 128, such as a ribbon cable. Electronics 126 control how the nozzles of printhead 100 jet droplets in response to control signals provided by the controller board.

Figure 2A:
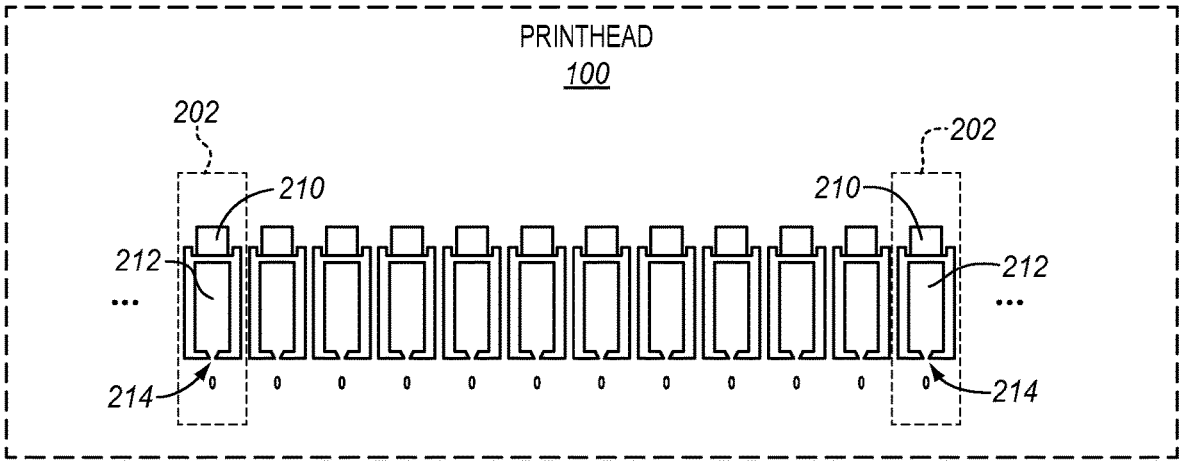
FIG. 2A is a schematic diagram of a row of jetting channels within a printhead in an illustrative embodiment.
Figure 2B:
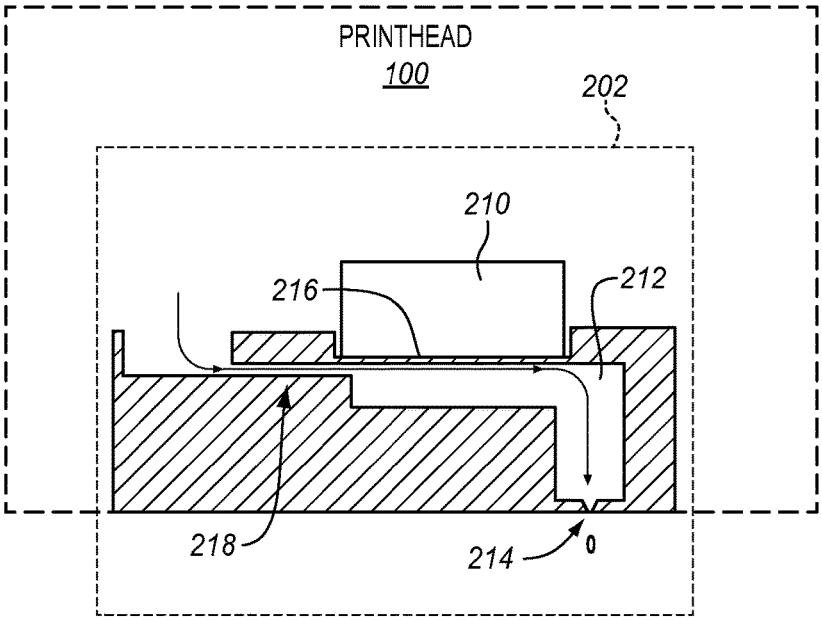
FIG. 2B is a schematic diagram of a jetting channel within a printhead in an illustrative embodiment.

FIG. 2A is a schematic diagram of a row 110 of jetting channels 202 within printhead 100 in an illustrative embodiment. Printhead 100 includes multiple jetting channels 202 that are arranged in a line or row (e.g., row 110 in FIG. 2) along a length of printhead 100, and each jetting channel 202 in a row may have a similar configuration as shown in FIG. 2A. Each jetting channel 202 includes a piezoelectric actuator 210, a pressure chamber 212, and a nozzle 214. FIG. 2B is a schematic diagram of a jetting channel 202 within printhead 100 in an illustrative embodiment. The view in FIG. 2B is of a cross-section of jetting channel 202 across a width of printhead 100. The arrow in FIG. 2B illustrates a flow path of a print fluid within jetting channel 202. The print fluid flows from a supply manifold in printhead 100 and into pressure chamber 212 through restrictor 218. Restrictor 218 fluidly connects pressure chamber 212 to a supply manifold, and controls the flow of the print fluid into pressure chamber 212. One wall of pressure chamber 212 is formed with a diaphragm 216 that physically interfaces with piezoelectric actuator 210. Diaphragm 216 may comprise a sheet of semi-flexible material that vibrates in response to actuation by piezoelectric actuator 210. The print fluid flows through pressure chamber 212 and out of nozzle 214 in the form of a droplet in response to actuation by piezoelectric actuator 210. Piezoelectric actuator 210 is configured to receive a drive waveform, and to actuate or "fire" in response to a jetting pulse on the drive waveform. Firing of piezoelectric actuator 210 in jetting channel 202 creates pressure waves in pressure chamber 212 that cause jetting of a droplet from nozzle 214.

Jetting channel 202 as shown in FIGS. 2A-2B is an example to illustrate a basic structure of a jetting channel, such as the actuator, pressure chamber, and nozzle. Other types of jetting channels are also considered herein. For example, some jetting channels may be a "flow-through" type having another restrictor that fluidly connects pressure chamber 212 to a return manifold (not shown) in printhead 100. Some jetting channels may have a pressure chamber having a different shape than is illustrated in FIGS. 2A and 2B. Some jetting channels may use another type of actuator other than a piezoelectric actuator.

Figure 3:
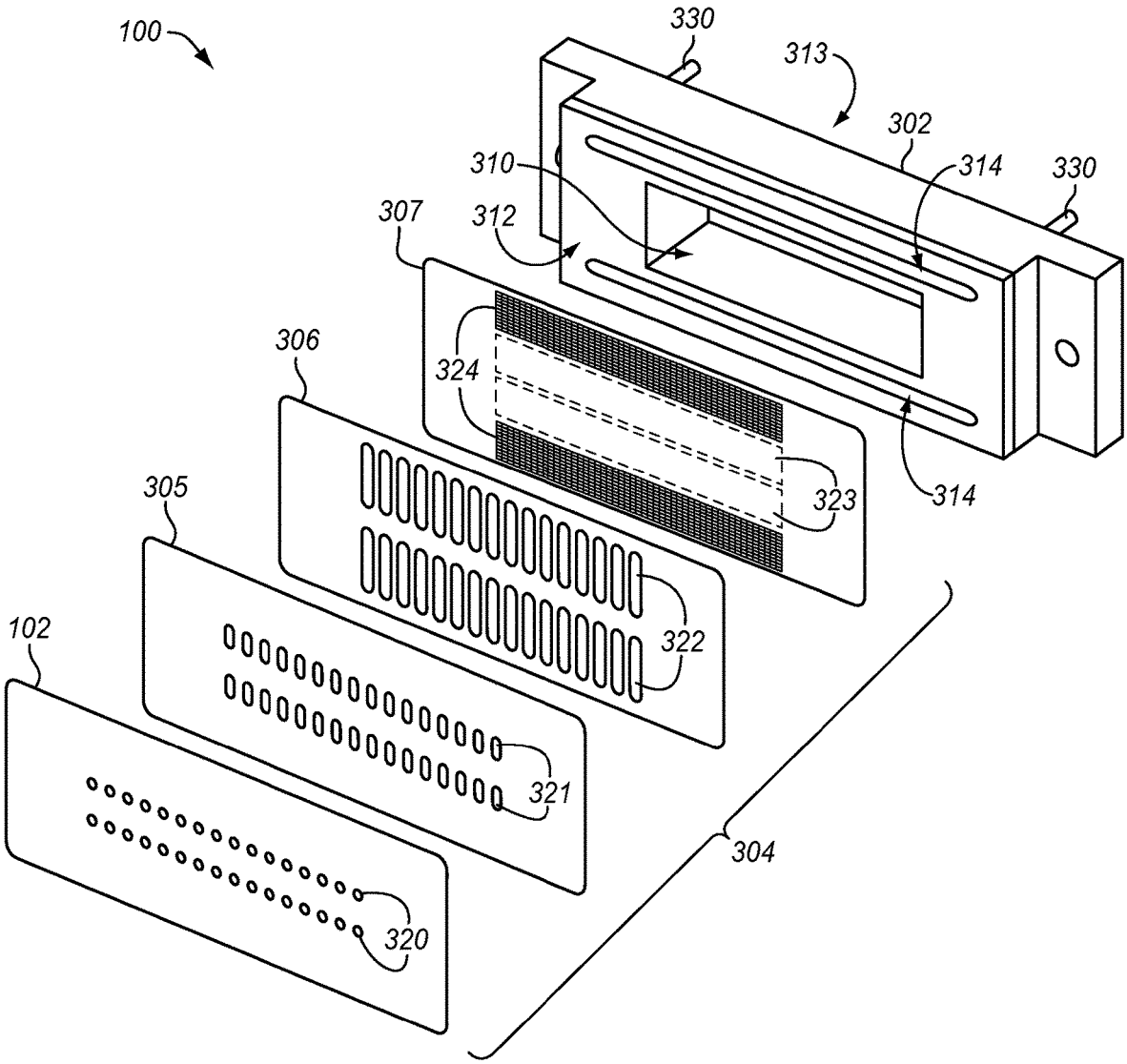
FIG. 3 illustrates an exploded, perspective view of a printhead in an illustrative embodiment.
Figure 4:
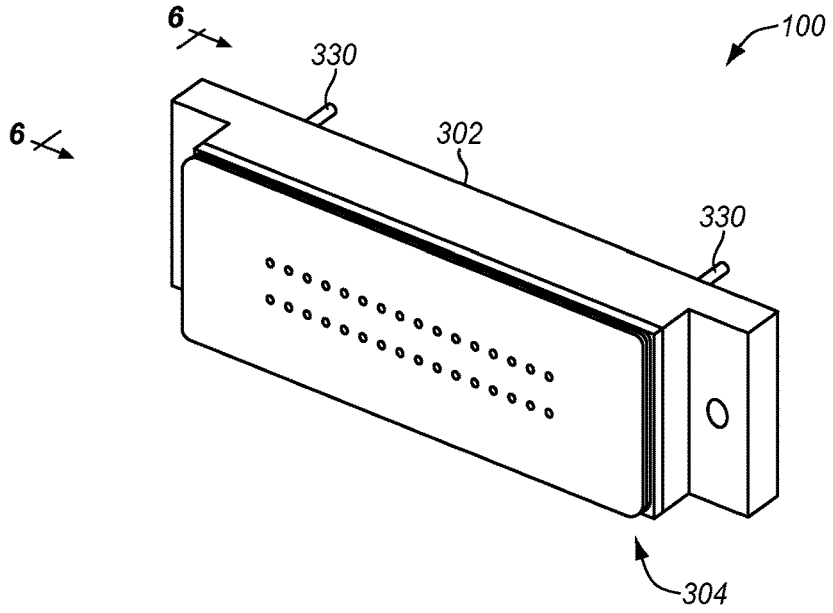
FIG. 4 is a perspective view of a printhead in an illustrative embodiment.

FIG. 3 illustrates an exploded, perspective view of printhead 100 in an illustrative embodiment. The illustration of printhead 100 in FIG. 3 is of a basic structure to show components of printhead 100, and the actual structure of printhead 100 may vary as desired. In this embodiment, printhead 100 is an assembly that includes a main body 302 and stack 304 of plates 102, 305-307 (also referred to as a laminate plate structure). Stack 304 is affixed or attached to main body 302, and forms one or more rows of jetting channels 202. FIG. 4 is a perspective view of printhead 100 in an illustrative embodiment. In FIG. 4, stack 304 is attached or affixed to main body 302.

In FIG. 3, main body 302 includes an access hole 310 at or near its center that extends from an interface surface 312 through to an opposing surface 313 (referred to as an inlet surface). Access hole 310 provides a passage way for an actuator assembly (not shown), such as a plurality of piezoelectric actuators, to pass through and interface with a diaphragm plate 307. Interface surface 312 is the surface of main body 302 that faces stack 304, and interfaces with a plate (e.g., plate 307) of stack 304. Main body 302 includes one or more supply manifolds 314 that extend substantially along a length of main body 302, and are configured to supply a print fluid to jetting channels 202 of printhead 100. Main body 302 also includes a plurality of supply ports 330 on inlet surface 313 that are configured to receive a print fluid from a fluid supply. For example, supply ports 330 may be connected to a fluid reservoir via hoses to receive print fluid from the fluid reservoir. Supply ports 330 are separated by a distance along a length of main body 302, such as on opposing sides of access hole 310. Supply manifold 314 is configured to provide a fluid path for the print fluid from supply ports 330 to the row of jetting channels 202, and the structure of supply manifold 314 is described in more below.

In FIG. 3, plates 102 and 305-307 of printhead 100 are fixed, bonded, or otherwise attached to one another to form stack 304, and stack 304 is affixed to main body 302. Stack 304 includes the following plates in this embodiment: nozzle plate 102, a chamber plate 305, a restrictor plate 306, and a diaphragm plate 307. Nozzle plate 102 includes one or more rows of nozzle openings 320 that form the nozzles 214 of jetting channels 202. Chamber plate 305 includes one or more rows of chamber openings 321 that form pressure chambers 212 of jetting channels 202. Although one chamber plate 305 is illustrated, there may be multiple chamber plates 305 used to form pressure chambers 212. Restrictor plate 306 is formed with a plurality of restrictor openings 322 that form restrictors 218 of jetting channels 202. Restrictor openings 322 fluidly connect supply manifold 314 to chamber openings 321, and control the flow of print fluid into chamber openings 321. Diaphragm plate 307 is formed with diaphragm sections 323 and filter sections 324. Diaphragm sections 323 each comprise a sheet of semi-flexible material that forms diaphragms 216 for jetting channels 202. Filter sections 324 remove foreign matter from the print fluid entering into restrictor openings 322. As stated above, the assembly of printhead 100 may include more or different plates than are illustrated in FIG. 3.

Figure 5:
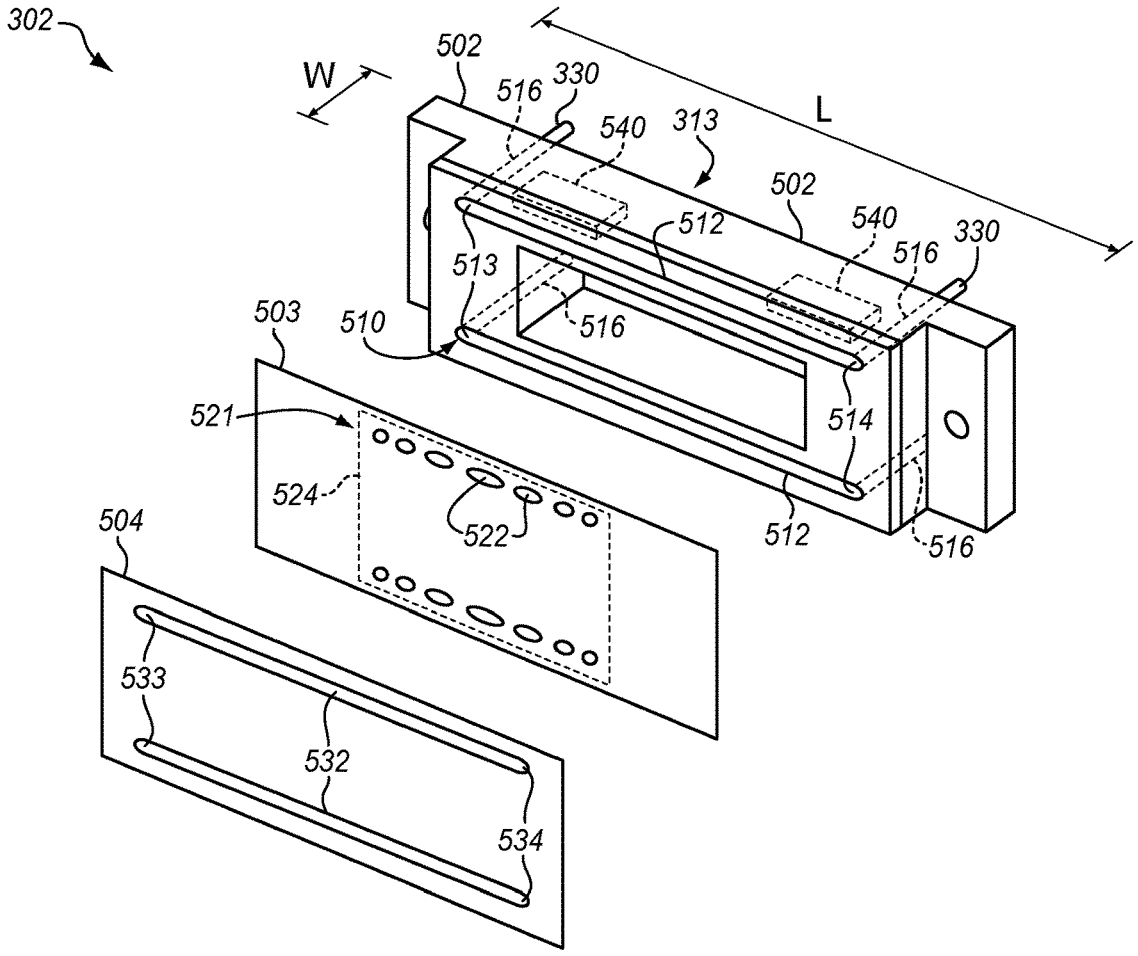
FIG. 5 is an exploded, perspective view of a main body of a print head in an illustrative embodiment.

FIG. 5 is an exploded, perspective view of main body 302 in an illustrative embodiment. In this embodiment, main body 302 includes a body member 502, a flow diversion plate 503, and a manifold plate 504. The structure of body member 502, flow diversion plate 503, and manifold plate 504 form the supply manifold 314 as illustrated in FIG. 3. When connected, flow diversion plate 503 is sandwiched between manifold plate 504 and an interface surface 510 of body member 502. Other plates may be used for main body 302 that are not shown for the sake of brevity, such as a spacer plate, multiple manifold plates 504, etc.

Body member 502 is an elongated member made from a rigid material, such as stainless steel. Body member 502 has a length (L) and a width (W), and the dimensions of body member 502 are such that the length is greater than the width. The direction of a row of jetting channels 202 corresponds with the length of body member 502. To form the supply manifold 314 that supplies a print fluid to a row of jetting channels 202, body member 502 includes one or more primary manifold ducts 512 on interface surface 510. Primary manifold duct 512 is an elongated cut or groove configured to convey a print fluid. Primary manifold duct 512 extends along interface surface 510 from a first end 513 to a second end 514. The length of primary manifold duct 512 may be at least as long as a row of jetting channels 202 in printhead 100. Body member 502 also includes fluid passages 516 that extend between primary manifold duct 512 and a supply port 330. A fluid passage 516 is a hole or opening that fluidly couples supply port 330 to primary manifold duct 512. In this embodiment, there is a fluid passage 516 toward each end 513-514 of primary manifold duct 512. One or more heaters 540 may be embedded in body member 502 proximate to primary manifold duct 512. A heater 540 is configured to heat the print fluid in primary manifold duct 512. Body member 502 may comprise a unibody structure, with primary manifold duct 512 and fluid passages 516 machined, milled, etched, or otherwise formed into the unibody structure.

To further form supply manifold 314, flow diversion plate 503 includes one or more rows 521 of orifices 522. A row 521 of orifices 522 is aligned with a primary manifold duct 512 on body member 502. An orifice 522 is a hole through flow diversion plate 503 that provides a pathway for print fluid. Manifold plate 504 includes one or more secondary manifold ducts 532 aligned with a primary manifold duct 512 on body member 502. A secondary manifold duct 532 is an elongated slot, cut, groove, or opening in manifold plate 504 configured to convey a print fluid. Secondary manifold duct 532 extends from a first end 533 to a second end 534 along a length of manifold plate 504. Secondary manifold duct 532 is the portion of supply manifold 314 that is fluidly coupled to the row of jetting channels 202 in printhead 100 for supplying a print fluid. Thus, the length of secondary manifold duct 532 may be at least as long as the row of jetting channels 202.

When flow diversion plate 503 and manifold plate 504 are affixed to body member 502, primary manifold duct 512 and secondary manifold duct 532 extend in parallel (in alignment with the row of jetting channels 202 when stack 304 is attached). Flow diversion plate 503 is configured to fluidly isolate secondary manifold duct 532 from primary manifold duct 512 at end sections, and to fluidly couple or fluidly connect secondary manifold duct 532 to primary manifold duct 512 toward a midsection. This, in effect, would cause a print fluid to flow through a length of primary manifold duct 512 before flowing through flow diversion plate 503 and into secondary manifold duct 532, as opposed to flowing directly from primary manifold duct 512 to secondary manifold duct 532 along their entire lengths. To divert the flow of print fluid, the positioning of orifices 522 in row 521 is selected so that a print fluid has to flow through a length of primary manifold duct 512. In one embodiment, orifices 522 in row 521 are formed toward a midsection 524 of flow diversion plate 503, and are not formed toward end sections of flow diversion plate 503. A spacing between orifices 522 at opposing ends of row 521 defines a length of row 521, and the length of row 521 is less than a length of primary manifold duct 512. With this configuration, a print fluid is forced to flow within primary manifold duct 512 before reaching the nearest orifice 522 at the end of row 521. Also, the pattern of orifices 522 in row 521 may be selected to further divert the flow of print fluid out of primary manifold duct 512. For example, the sizes of orifices 522 in row 521 may vary depending on their position in row 521. In one embodiment, the sizes of orifices 522 may decrease from a middle of row 521 to ends of row 521. For instance, the middle orifice(s) 522 in row 521 may have the largest size, and the size of orifices 522 may decrease from the middle orifice(s) 522 toward the end orifices 522. The shape of orifices 522 may vary also within row 521. Some orifices 522 may have an elliptical shape, some may have a circular shape, etc.

Figure 6:
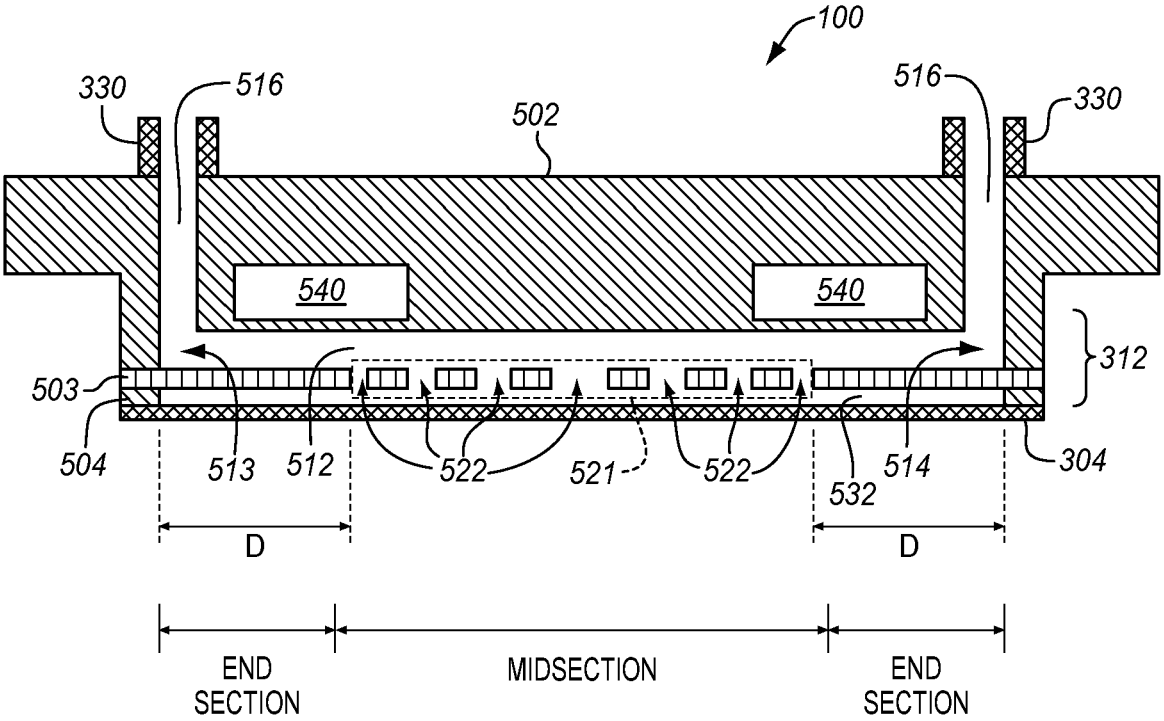
FIG. 6 is a cross-sectional view of a printhead in an illustrative embodiment.

FIG. 6 is a cross-sectional view of printhead 100 in an illustrative embodiment. The cross-section shown in FIG. 6 is along view arrows 6-6 in FIG. 4. Through this cross-sectional view, the elements of supply manifold 314 are visible. Body member 502 includes primary manifold duct 512 that extends (left to right in FIG. 6) between ends 513-514. Body member 502 also includes fluid passages 516 that fluidly couple supply ports 330 to opposing ends 513-514 of primary manifold duct 512. Thus, print fluid is supplied to primary manifold duct 512 at opposing ends 513-514 in this embodiment. Heaters 540 are also shown as being embedded in body member 502. Manifold plate 504 forms secondary manifold duct 532. Fluid diversion plate 503 is sandwiched between manifold plate 504 and body member 502, and includes a row 521 of orifices 522. In this cross-section, a midsection of a length of body member 502, plates 503-504, primary manifold duct 512, secondary manifold duct 532, etc., are shown. In the elongated elements discussed herein, the midsection is a section toward or centered about the middle of a length of a structure or body. The end sections are separated by the midsection along the length. In this embodiment, orifices 522 are positioned toward the midsection of the length of primary manifold duct 512, and no orifices 522 are positioned toward the end sections of the length of primary manifold duct 512. More particularly, row 521 has "end" orifices 522 that are at the ends of row 521. The end orifices 522 are nearest the ends 513-514 of primary manifold duct 512. The end orifices 522, which are nearest end 513-514 of primary manifold duct 512, are separated from ends 513-514 by a threshold distance, respectively. For example, the distance between an end 513-514 of primary manifold duct 512 and an end orifice 522 is indicated by "D", and the distance D is selected to be greater than the threshold distance. The threshold distance may be selected based on a heating time of the print fluid in primary manifold duct 512 due to heaters 540. Because heaters 540 are embedded proximate to primary manifold duct 512, the print fluid is heated as it flows through primary manifold duct 512. The longer the print fluid flows through primary manifold duct 512, the more the print fluid is heated. Thus, the distance D may be selected so that the print fluid is forced to flow at least the threshold distance through primary manifold duct 512. Also, the size of orifices 522 may increase in size from end orifices 522 to a center orifice 522. Thus, the majority of print fluid will flow past the end orifices 522 and toward the center of primary manifold duct 512 where the orifices 522 are larger. This allows the print fluid to flow longer within primary manifold duct 512, which provides further heating time.

Figure 7:
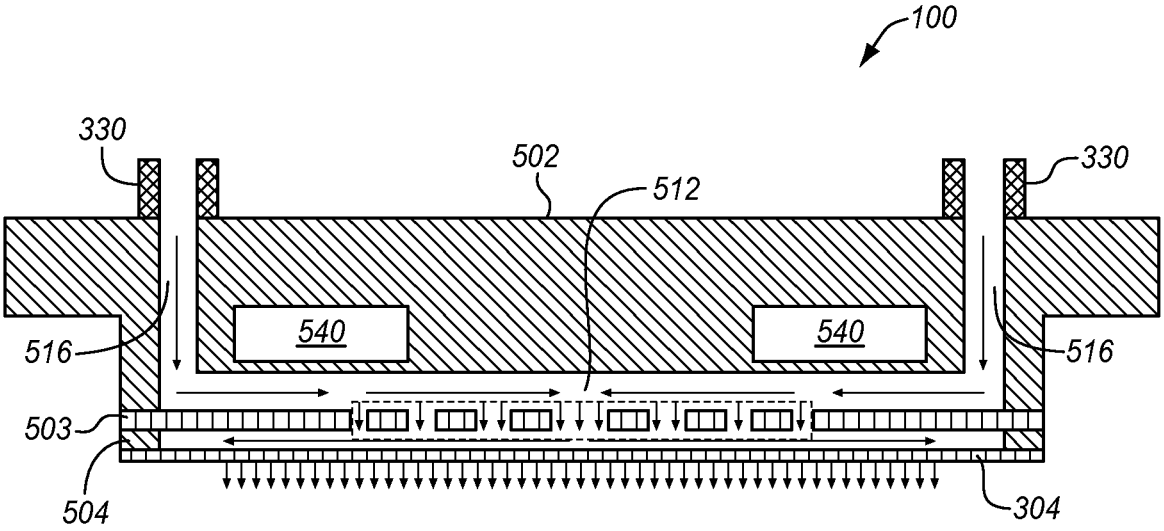
FIG. 7 is a cross-sectional view of a printhead showing a flow of print fluid in an illustrative embodiment.

FIG. 7 is a cross-sectional view of printhead 100 showing a flow of print fluid in an illustrative embodiment. The print fluid is received at supply ports 330, and flows through fluid passages 516 into primary manifold duct 512. The print fluid flows from ends 513-514 of primary manifold duct 512 toward the center of primary manifold duct 512. As the print fluid flows through primary manifold duct 512, the print fluid will flow through orifices 522 in fluid diversion plate 503 and into secondary manifold duct 532. The print fluid will then flow through secondary manifold duct 532 to supply the jetting channels 202 with the print fluid for jetting. As is evident in FIG. 7, the print fluid is forced to flow at least a threshold distance within primary manifold duct 512 before it is allowed to flow through to secondary manifold duct 532. Thus, the print fluid is allowed time to increase in temperature via heaters 540 while flowing through primary manifold duct 512, which can improve performance.

Although specific embodiments were described herein, the scope of the invention is not limited to those specific embodiments. The scope of the invention is defined by the following claims and any equivalents thereof.

What is claimed is:

1. A printhead comprising:

a main body configured to attach to a stack of plates, wherein the stack of plates forms a row of jetting channels configured to jet droplets of a print fluid;

wherein the main body includes a supply manifold configured to provide a fluid path for the print fluid to the row of jetting channels;

wherein the supply manifold comprises a primary manifold duct and a secondary manifold duct that extend in parallel in alignment with the row of jetting channels;

wherein the primary manifold duct receives the print fluid from a fluid supply at opposing end sections;

wherein the primary manifold duct is fluidly isolated from the secondary manifold duct at the end sections, and is fluidly coupled to the secondary manifold duct toward a midsection of a length of the primary manifold duct so that the print fluid flows along the primary manifold duct, into the secondary manifold duct, and to the row of jetting channels.

2. The printhead of claim 1 wherein the supply manifold further comprises:

a fluid diversion plate disposed between the primary manifold duct and the secondary manifold and that fluidly isolates the primary manifold duct from the secondary manifold duct at the end sections of the primary manifold duct;

wherein the fluid diversion plate includes at least one orifice, positioned toward the midsection of the length of the primary manifold duct, that fluidly couples the primary manifold duct to the secondary manifold duct.

3. The printhead of claim 2 wherein the at least one orifice comprises:

a plurality of orifices in a row aligned with the primary manifold duct and the secondary manifold duct.

4. The printhead of claim 3 wherein:

sizes of the orifices decrease from a middle of the row of orifices to ends of the row of orifices.

5. The printhead of claim 3 wherein:

a first one of the orifices nearest a first end of the primary manifold duct is separated from the first end by a threshold distance; and a second one of the orifices nearest a second end of the primary manifold duct is separated from the second end by the threshold distance.

6. The printhead of claim 5 further comprising:

at least one heater embedded in the main body proximate to the primary manifold duct, and configured to heat the print fluid in the primary manifold duct.

7. The printhead of claim 6 wherein:

the threshold distance is selected based on a heating time of the print fluid in the primary manifold duct due to the at least one heater.

8. The printhead of claim 1 wherein:

a length of the secondary manifold duct is at least as long as the row of jetting channels.

9. A printhead comprising:

a main body; and a stack of plates attached to the main body, and that forms a row of jetting channels configured to jet droplets of a print fluid;

wherein the main body includes:

a rigid body member;

a manifold plate; and a flow diversion plate sandwiched between an interface surface of the rigid body member and the manifold plate;

wherein the rigid body member includes a primary manifold duct formed into the interface surface, supply ports configured to receive the print fluid from a fluid supply, and fluid passages allowing the print fluid to flow from the supply ports to the primary manifold duct;

wherein the flow diversion plate includes a row of orifices in alignment with the primary manifold duct;

wherein the manifold plate includes a manifold opening that forms a secondary manifold duct in alignment with the primary manifold duct;

wherein the row of orifices of the flow diversion plate provides a pathway for the print fluid from the primary manifold duct to the secondary manifold duct, which supplies the print fluid to the row of jetting channels.

10. The printhead of claim 9 wherein:

the orifices in the row of orifices are formed toward a midsection of the flow diversion plate.

11. The printhead of claim 10 wherein:

sizes of the orifices decrease from a middle of the row of orifices to ends of the row of orifices.

12. The printhead of claim 10 wherein:

a spacing between the orifices at opposing ends of the row of orifices defines a length of the row of orifices; and the length of the row of orifices is less than a length of the primary manifold duct.

13. The printhead of claim 9 wherein:

the orifices are elliptical.

14. The printhead of claim 9 wherein:

the fluid passages are disposed toward each end of the primary manifold duct.

15. A printhead comprising:

a main body having supply ports configured to receive a print fluid; and a stack of plates attached to the main body, and that forms a row of jetting channels configured to jet droplets of the print fluid;

wherein the main body includes a supply manifold configured to provide a fluid path for the print fluid from the supply ports to the row of jetting channels;

wherein the supply manifold comprises:

a first fluid passage that fluidly couples to a first one of the supply ports;

a second fluid passage that fluidly couples to a second one of the supply ports, wherein the first one of the supply ports and the second one of the supply ports are separated by a distance along a length of the main body;

a primary manifold duct extending between the first fluid passage and the second fluid passage;

a secondary manifold duct that extends in alignment with the primary manifold duct, and fluidly couples with the row of jetting channels; and a fluid diversion plate disposed between the primary manifold duct and the secondary manifold duct, and that fluidly isolates the primary manifold duct from the secondary manifold duct at end sections of the primary manifold duct;

wherein the fluid diversion plate includes at least one orifice, positioned toward a midsection of a length of the primary manifold duct, that fluidly couples the primary manifold duct to the secondary manifold duct.

16. The printhead of claim 15 wherein the at least one orifice comprises:

a plurality of orifices in a row aligned with the primary manifold duct and the secondary manifold duct.

17. The printhead of claim 16 wherein:

sizes of the orifices decrease from a middle of the row of orifices to ends of the row of orifices.

18. The printhead of claim 16 wherein:

a first one of the orifices nearest a first end of the primary manifold duct is separated from the first end by a threshold distance; and a second one of the orifices nearest a second end of the primary manifold duct is separated from the second end by the threshold distance.

19. The printhead of claim 15 wherein:

a length of the secondary manifold duct is at least as long as the row of jetting channels.

20. The printhead of claim 15 further comprising:

at least one heater embedded in the main body proximate to the primary manifold duct.

* * * * *